US012151787B2

(12) United States Patent
Fuqua et al.

(10) Patent No.: US 12,151,787 B2
(45) **Date of Patent: *Nov. 26, 2024**

(54) SUBSURFACE MULTI-MISSION DIVER TRANSPORT VEHICLE

(71) Applicant: Patriot3, Inc., Fredericksburg, VA (US)

(72) Inventors: Charles Louis Fuqua, Woodbridge, VA (US); Steven Scott Kahre, Spotsylvania, VA (US)

(73) Assignee: Patriot3, Inc., Fredericksburg, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/216,961

(22) Filed: Jun. 30, 2023

(65) Prior Publication Data

US 2023/0339584 A1 Oct. 26, 2023

Related U.S. Application Data

(63) Continuation of application No. 17/828,420, filed on May 31, 2022, now Pat. No. 11,745,839, which is a continuation of application No. 16/979,260, filed as application No. PCT/US2019/021626 on Mar. 11, 2019, now Pat. No. 11,352,109.

(60) Provisional application No. 62/640,905, filed on Mar. 9, 2018.

(51) Int. Cl.

| | |
|---|---|
| ***B63C 11/46*** | (2006.01) |
| ***B63G 8/00*** | (2006.01) |
| ***B63G 8/08*** | (2006.01) |

(52) U.S. Cl.

CPC ..... *B63C 11/46* (2013.01); *B63G 8/001* (2013.01); *B63G 8/08* (2013.01)

(58) Field of Classification Search

CPC .. B63G 8/00; B63G 8/001; B63G 8/08; B63C 11/00; B63C 11/46

USPC ..... 114/315

See application file for complete search history.

(56) References Cited

U.S. PATENT DOCUMENTS

| | | | |
|---|---|---|---|
| 2,710,458 | A | 6/1955 | Reed |
| 3,685,480 | A | 8/1972 | Peroni |
| 5,158,034 | A | 10/1992 | Hsu |
| 5,349,918 | A | 9/1994 | Elie |
| 5,483,144 | A | 1/1996 | Marek |

(Continued)

FOREIGN PATENT DOCUMENTS

| | | |
|---|---|---|
| CN | 105691561 | 6/2016 |
| WO | 2008088290 | 7/2008 |

OTHER PUBLICATIONS

"Patriot-3M diver propulsion" (Covert Shores) Aug. 7, 2018 (Aug. 7, 2018), entire document, [online] retrieved from <URL: http://www.hisutton.com/Seacraft_DPC.html>.

(Continued)

*Primary Examiner* — Lars A Olson

(74) *Attorney, Agent, or Firm* — Schwartz Law Firm, P.C.

(57) ABSTRACT

A subsurface diver transport vehicle includes a vehicle body and at least one propulsion device. The vehicle body incorporates a number of individual mission modules mechanically assembled together to define a substantially continuous hull and deck of the vehicle. The mission modules include at least one battery module adapted for supplying electrical current to electrical subsystems of the vehicle. The propulsion device is attached to the vehicle body and capable of propelling the vehicle through a body of water.

18 Claims, 26 Drawing Sheets

(56) References Cited

U.S. PATENT DOCUMENTS

| | | | | |
|---|---|---|---|---|
| 5,666,900 | A | 9/1997 | Carroll, III et al. | |
| 6,615,761 | B2 | 9/2003 | Wyman | |
| 6,684,803 | B1 | 2/2004 | Dickson | |
| 6,976,445 | B1 | 12/2005 | Arneson | |
| 7,290,496 | B2 | 11/2007 | Asfar et al. | |
| 7,549,902 | B2 | 6/2009 | Jansen | |
| 8,276,536 | B2 | 10/2012 | Winskey et al. | |
| 11,352,109 | B2 | 6/2022 | Fuqua | |
| 11,745,839 | B2 * | 9/2023 | Fuqua | B63G 8/001 114/315 |
| 2001/0025594 | A1 | 10/2001 | Daniels | |
| 2014/0318435 | A1 | 10/2014 | Murray, III et al. | |
| 2017/0253313 | A1 | 9/2017 | Easterling | |

OTHER PUBLICATIONS

Ben Kinnaman, Bill Hellman, Jeff Carr, "User Interface for Diver Propulsion Device" (Sea Technology), entire document, ISSN 0093-3651.

"Wireless Control of Servo Motor" (electronicsforu.com) entire document, [online] retrieved from <URL: https://www.electronicsforu.com/electronics-projects/wireless-control-servo-motor>.

* cited by examiner

SUBSURFACE MULTI-MISSION DIVER TRANSPORT VEHICLE

TECHNICAL FIELD AND BACKGROUND OF THE DISCLOSURE

The present disclosure relates broadly and generally to a subsurface multi-mission diver transport vehicle. In exemplary embodiments, the invention features increased diver safety, distance and duration, speed and expandability. It is our belief the KRAKEN has met these goals and has set a new standard in sub-surface, autonomous capability.

One primary use and objective of any subsurface vehicle (SV) is to provide divers a mode of transportation with increased range of underwater travel. A SV increases underwater range in two ways—by traveling at greater speeds than finning (swimming) and by reducing consumption of breathing gas as a result of decreased diver physical effort. A typical SV transports a single combat diver or team of divers to a mission location and remains on station until time to return to base. Current SV market offerings require a team (pilot and co-pilot) to navigate, can be cumbersome to maneuver, and have little or no capability for operational expansion or mission-specific customization.

SUMMARY OF EXEMPLARY EMBODIMENTS

Various exemplary embodiments of the present disclosure are described below. Use of the term "exemplary" means illustrative or by way of example only, and any reference herein to "the invention" is not intended to restrict or limit the invention to exact features or steps of any one or more of the exemplary embodiments disclosed in the present specification. References to "exemplary embodiment," "one embodiment," "an embodiment," "various embodiments," and the like, may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

It is also noted that terms like "preferably", "commonly", and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

According to one exemplary embodiment, the present disclosure comprises a subsurface multi-mission diver transport vehicle includes a vehicle body and at least one propulsion device. The vehicle body incorporates a number of individual mission modules mechanically assembled together to define a substantially continuous hull and deck of the vehicle. The mission modules comprise at least one battery module adapted for supplying electrical current to electrical subsystems of the vehicle. The propulsion device is attached to the vehicle body and capable of propelling the vehicle through a body of water.

The modular design of the exemplary vehicle enable ready and convenient modification to suit requirements for any specific mission. The addition of battery modules allows the vehicle to traverse greater underwater distances and to increase its average speed for extended periods. Modularity allows for the rapid exchange or replacement of modules in the event of a problem. The exemplary vehicle can operate with a minimum of one battery module or with as many as five or more modules—each additional module increasing the structural length and overall capacity of the vehicle. Through its modular design, the exemplary vehicle can incorporate mission-specific, ancillary modules that expand its capability beyond diver deployment. Such ancillary modules can include drone launching (both UUV and AUV), ordinance deployment (both air and sub-surface), "Boat Air" for divers, saving the use of a diver's smaller rig (MODE, CODE, etc.), deployment of surveillance apparatus, and more.

According to another exemplary embodiment, the plurality of mission modules comprises a detachable rear module.

According to another exemplary embodiment, the rear module comprises first and second rear thrusters.

According to another exemplary embodiment, first and second pivoting hyrdofoils adjustably attach respective rear thrusters to the rear module.

According to another exemplary embodiment, the rear module further comprises an integrated servomotor operatively connected to at least one of the first and second rear thrusters.

According to another exemplary embodiment, the plurality of mission modules further comprises a detachable front module.

According to another exemplary embodiment, the front module comprises port and starboard bow thrusters.

According to another exemplary embodiment, first and second pivoting hyrdofoils adjustably attach respective bow thrusters to the front module.

According to another exemplary embodiment, the front module further comprises an integrated servomotor operatively connected to at least one of the first and second bow thrusters.

According to another exemplary embodiment, a drive control system is adapted for controlling the propulsion device.

According to another exemplary embodiment, the drive control system comprises at least one diver-operated joystick.

According to another exemplary embodiment, the battery module comprises flexible conductive battery cables extending from one end of the battery module and complementary battery cable connectors located at an opposite end of the battery module.

According to another exemplary embodiment, the battery module further comprises a distribution manifold and a plurality of individual battery packs electrically connected to the distribution manifold.

According to another exemplary embodiment, the battery module further comprises an undercarriage for holding the plurality of battery packs.

According to another exemplary embodiment, each of the mission modules has a substantially U-shaped exterior hull section and a substantially flat, continuous deck section.

According to another exemplary embodiment, each of the mission modules comprises port and starboard diver handles.

According to another exemplary embodiment, each mission module has a substantially U-shaped end flange adapted for engaging a corresponding U-shaped end flange of an adjacent mission module.

According to another exemplary embodiment, adjacent mission modules comprise respective male and female dovetails cooperating when assembled to form an interlocking joint mechanically connecting the mission modules together.

According to another exemplary embodiment, adjacent mission modules further comprise a spring-loaded extendable locking pin and a complementary pin receptacle cooperating to mechanically connect the mission modules together.

According to another exemplary embodiment, adjacent mission modules further comprise a locking latch and a complementary latch pin cooperating to mechanically connect the mission modules together.

BRIEF DESCRIPTION OF THE DRAWINGS

Exemplary embodiments of the present disclosure will hereinafter be described in conjunction with the following drawing figures, wherein like numerals denote like elements, and wherein.

DESCRIPTION OF EXEMPLARY EMBODIMENTS AND BEST MODE

The present invention is described more fully hereinafter with reference to the accompanying drawings, in which one or more exemplary embodiments of the invention are shown. Like numbers used herein refer to like elements throughout. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention, which is to be given the full breadth of the appended claims and any and all equivalents thereof. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Figure 1:
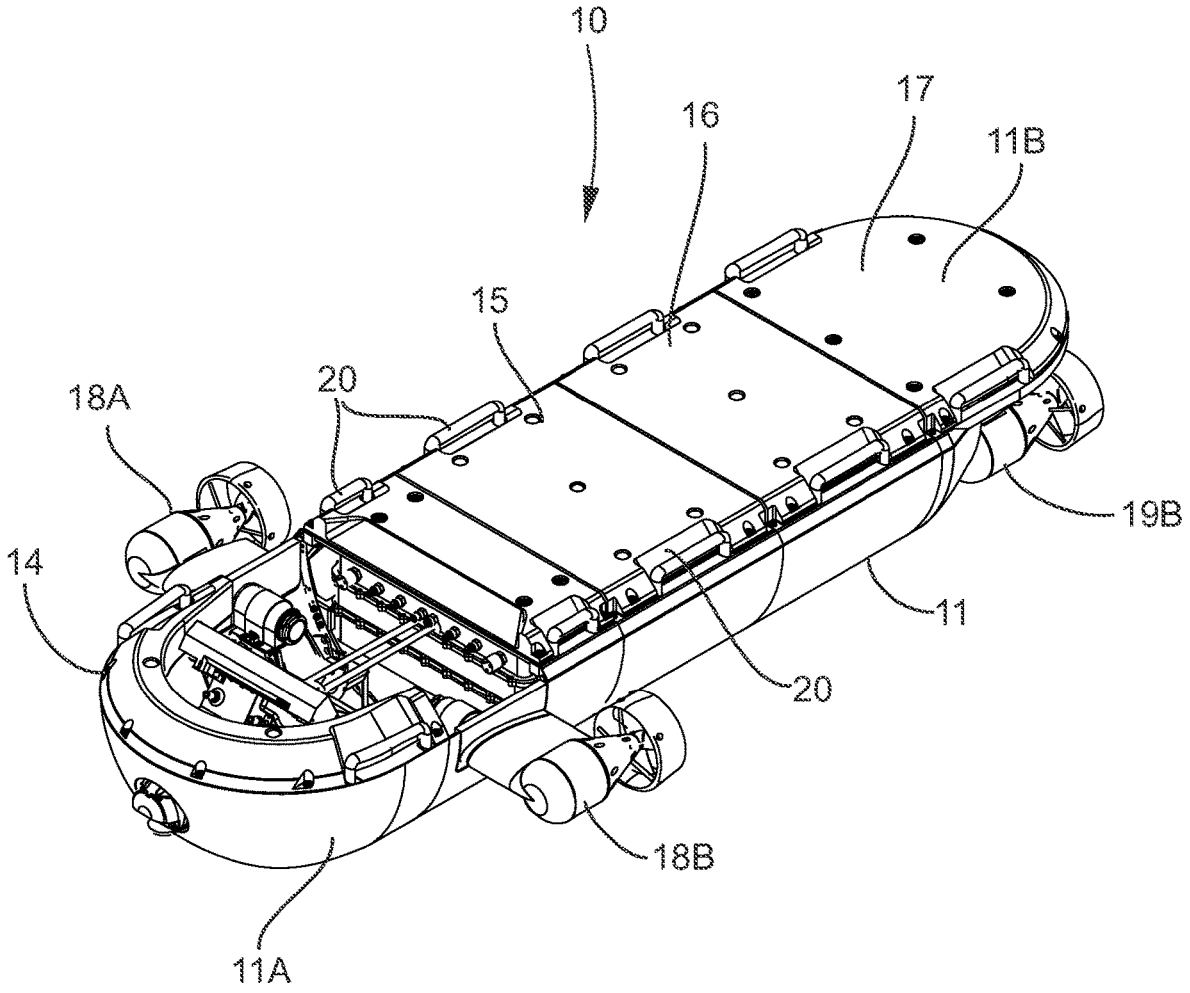
FIG. 1 is a perspective view of a subsurface multi-mission diver transport vehicle according to one exemplary embodiment of the present disclosure.
Figure 2:
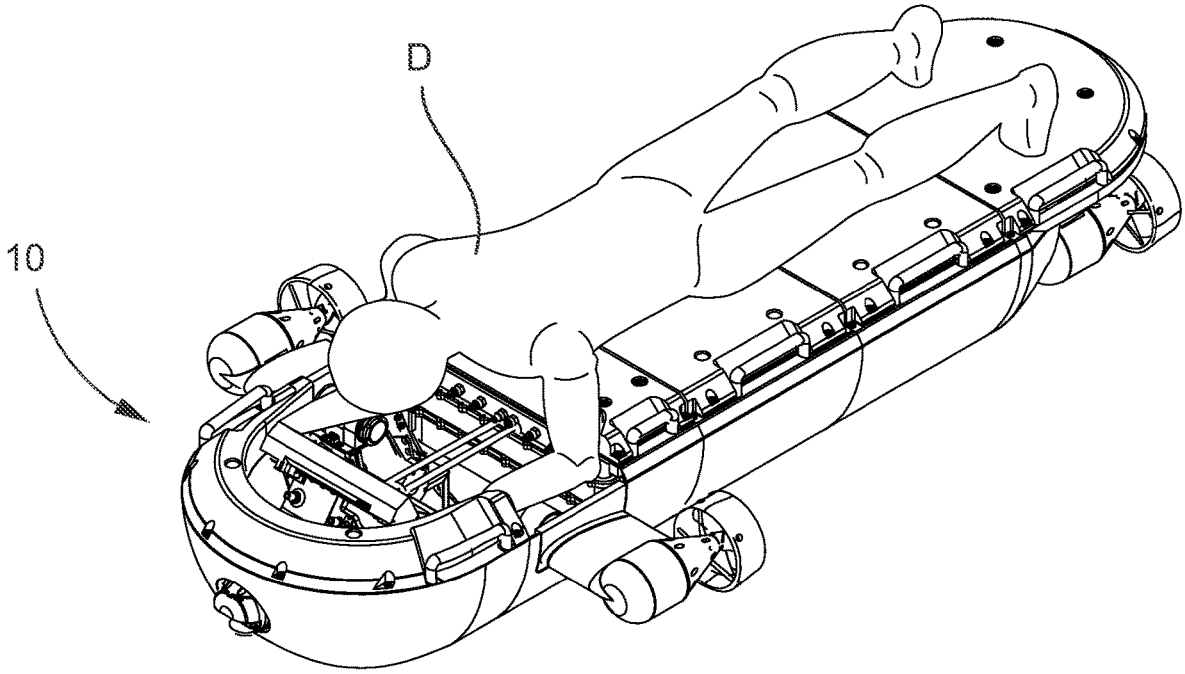
FIG. 2 is a further perspective view of the exemplary subsurface vehicle showing a diver (operator) in a vehicle-operating prone position on the flat deck.
Figure 3:
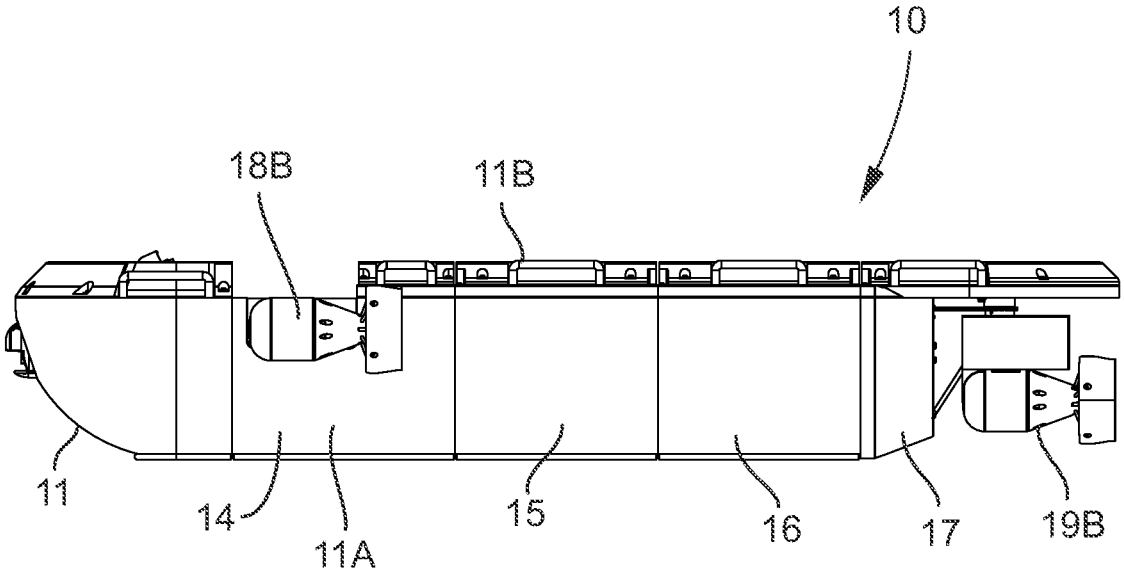
FIG. 3 is a side view of the exemplary subsurface vehicle.
Figure 4:
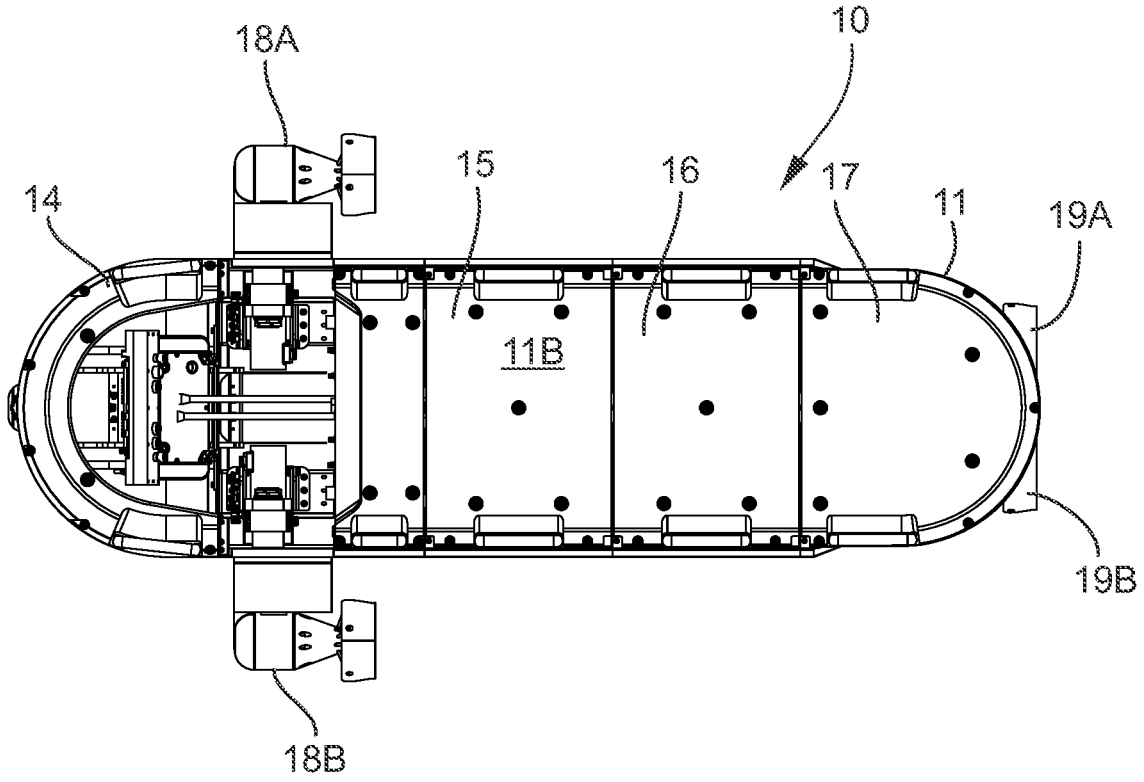
FIG. 4 is top view of the exemplary subsurface vehicle.
Figure 5:
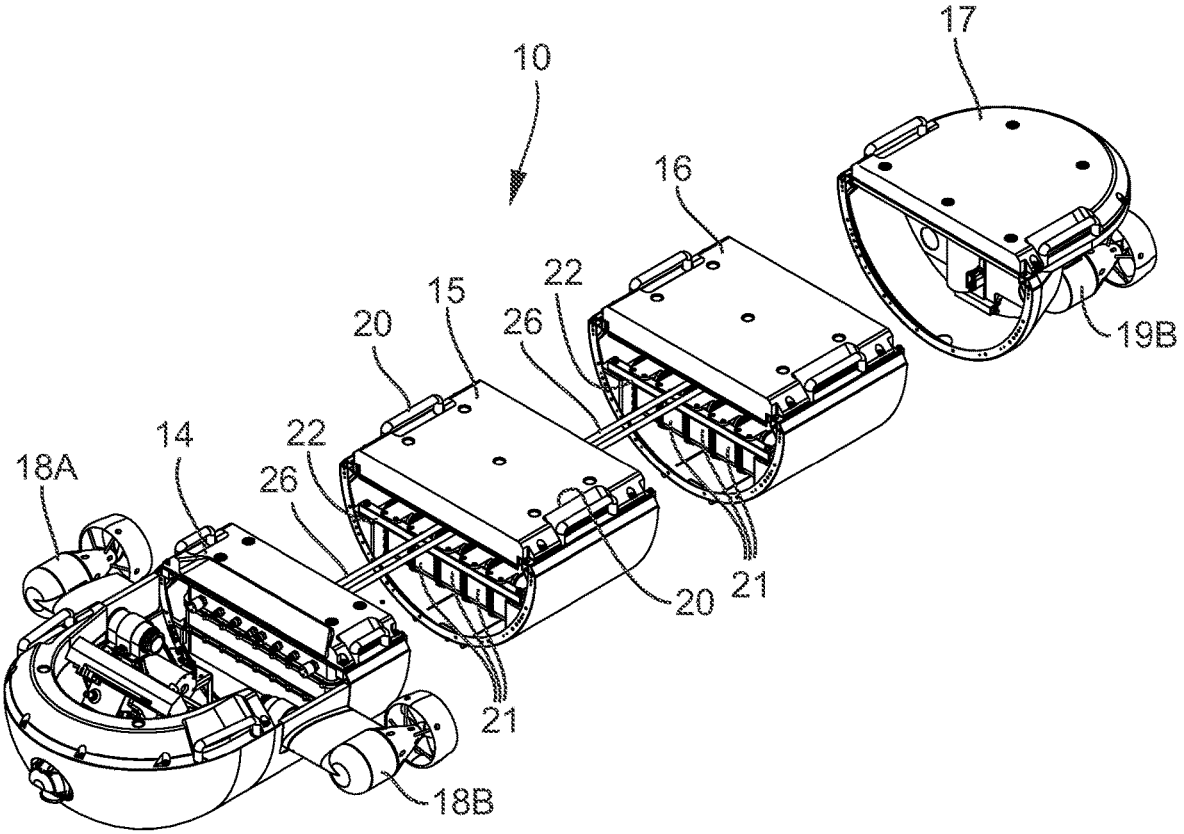
FIG. 5 is an exploded perspective view of the exemplary subsurface vehicle showing its various mission modules detached.
Figure 6:
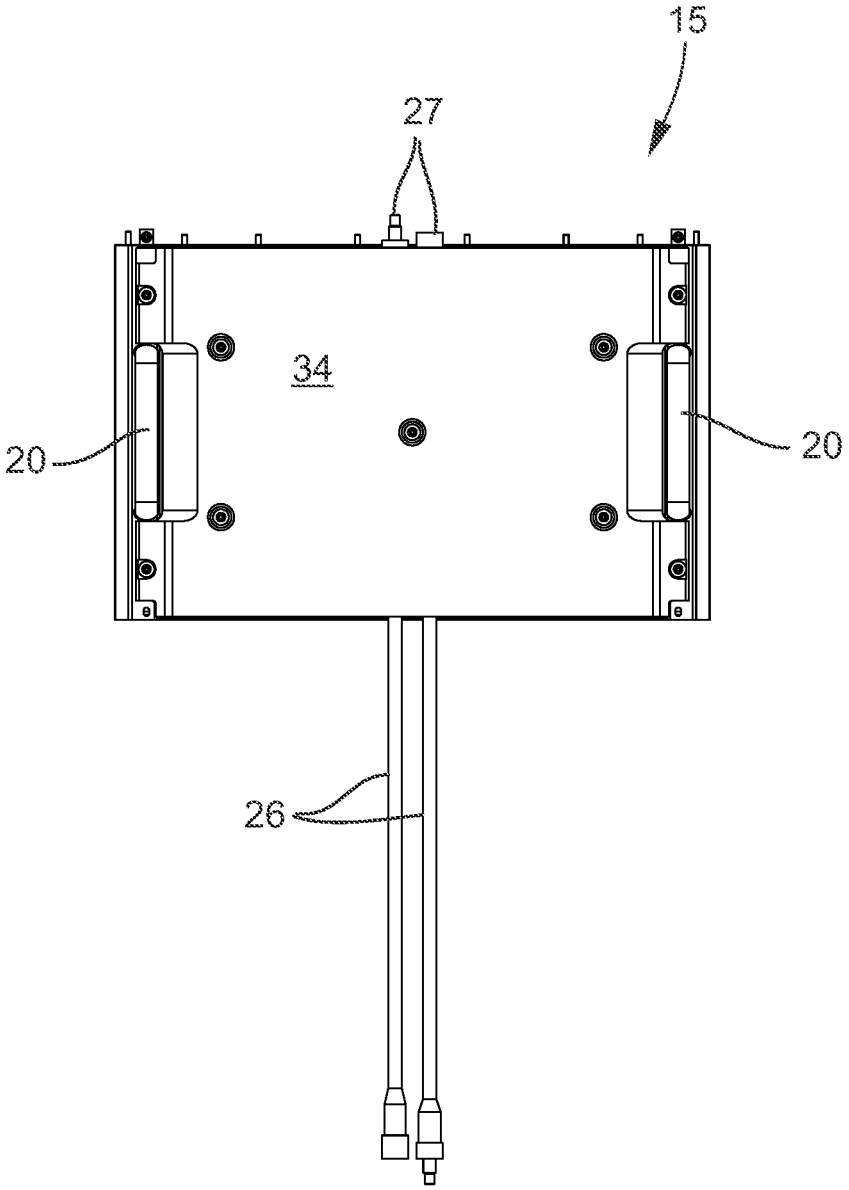
FIG. 6 is a top view of the exemplary battery module.
Figure 7:
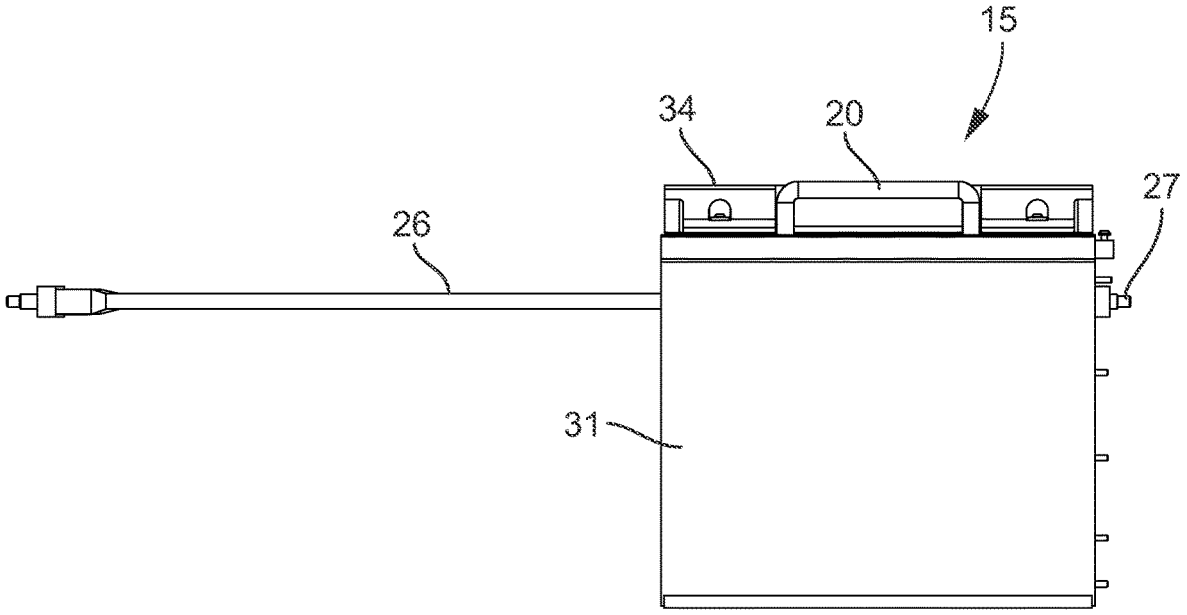
FIG. 7 is a side view of the exemplary battery module.
Figure 8:
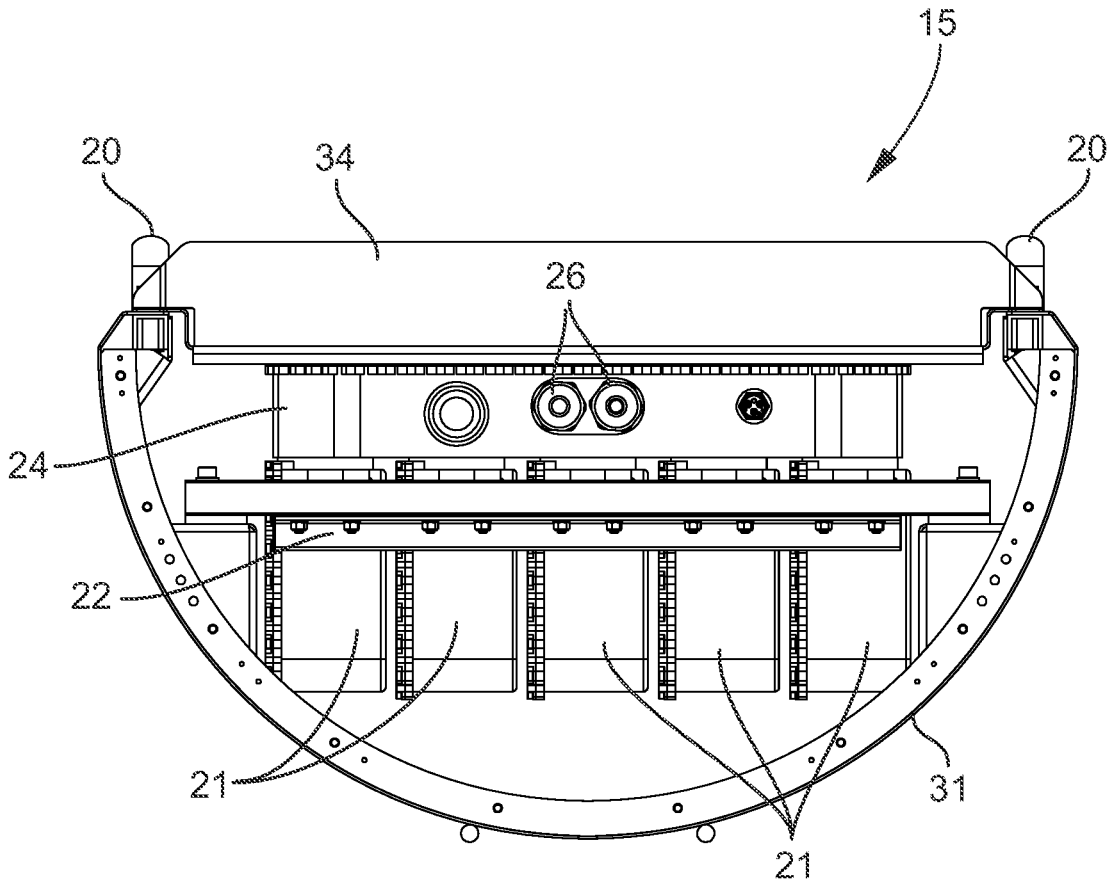
FIG. 8 is an end view of the exemplary battery module.
Figure 9:
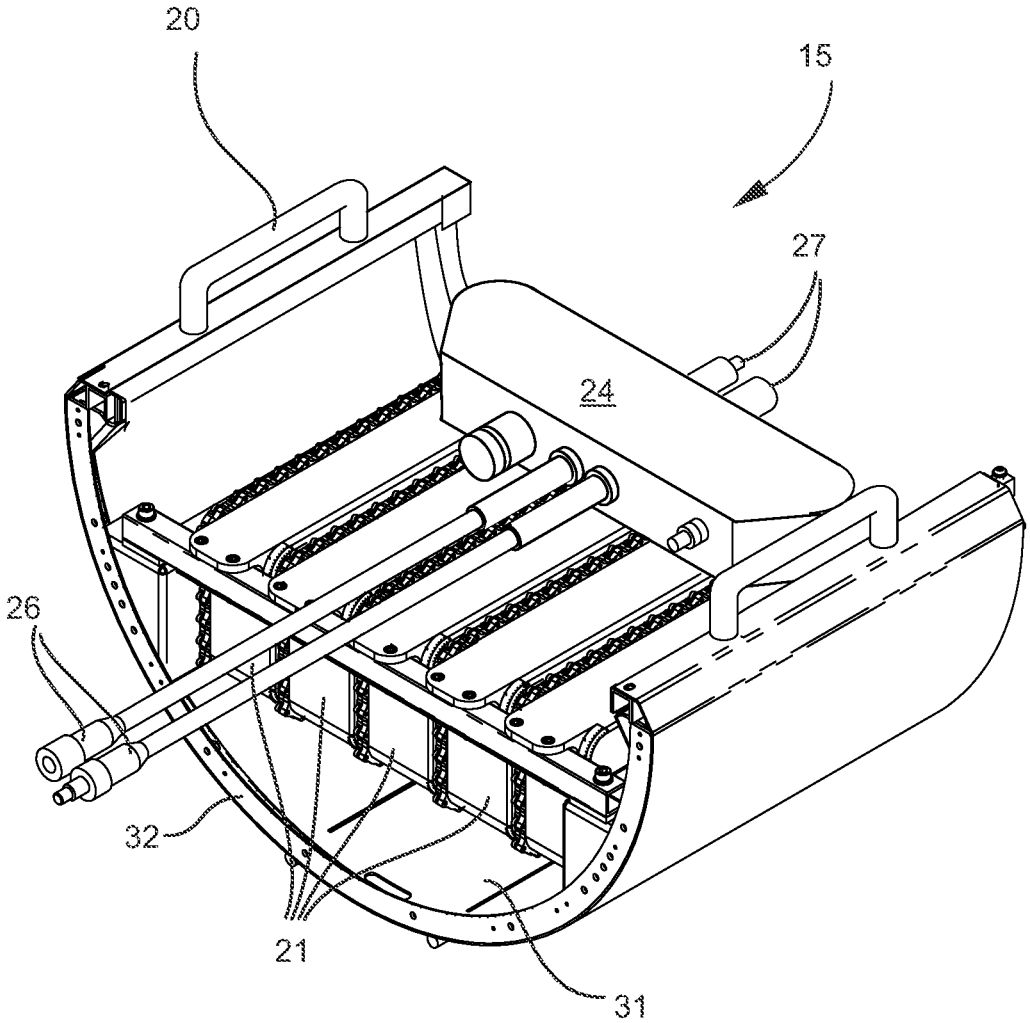
FIG. 9 is a perspective view of the exemplary battery module with the top deck removed to better illustrate internal elements of the module.
Figure 10:
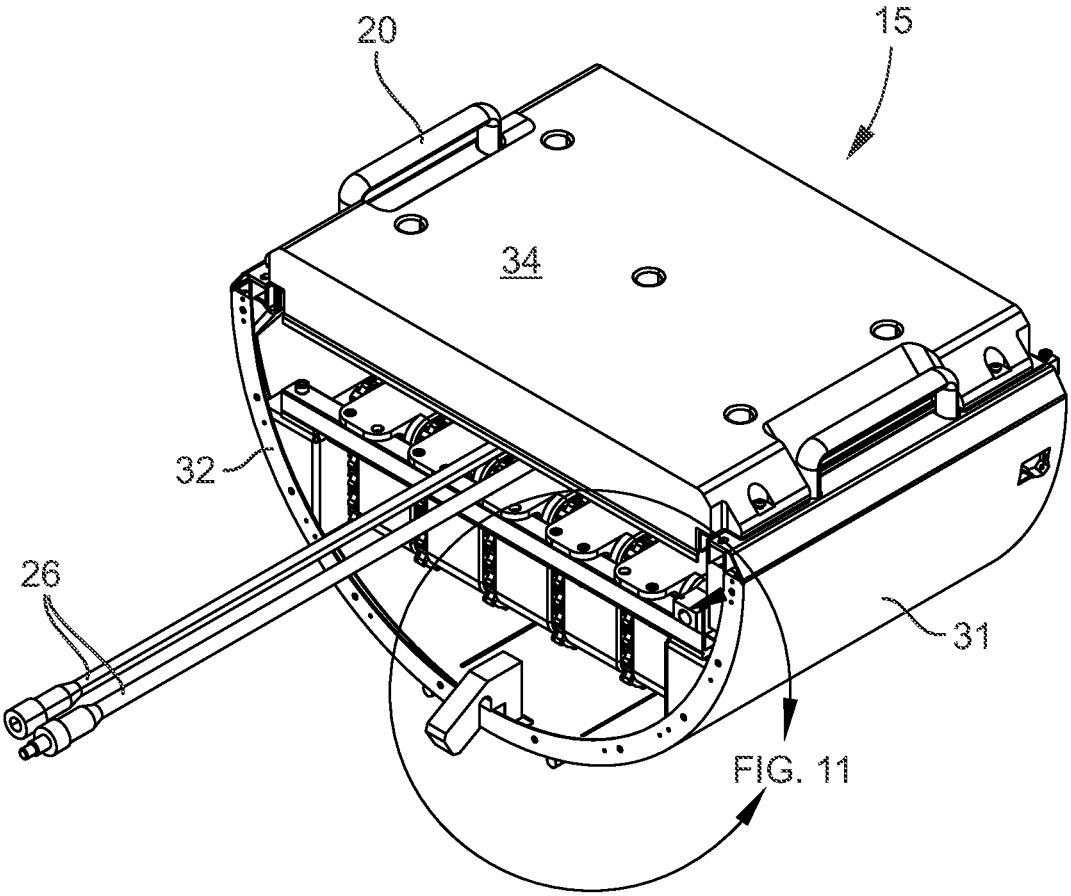
FIG. 10 is a front end perspective view of the exemplary battery module.
Figure 11:
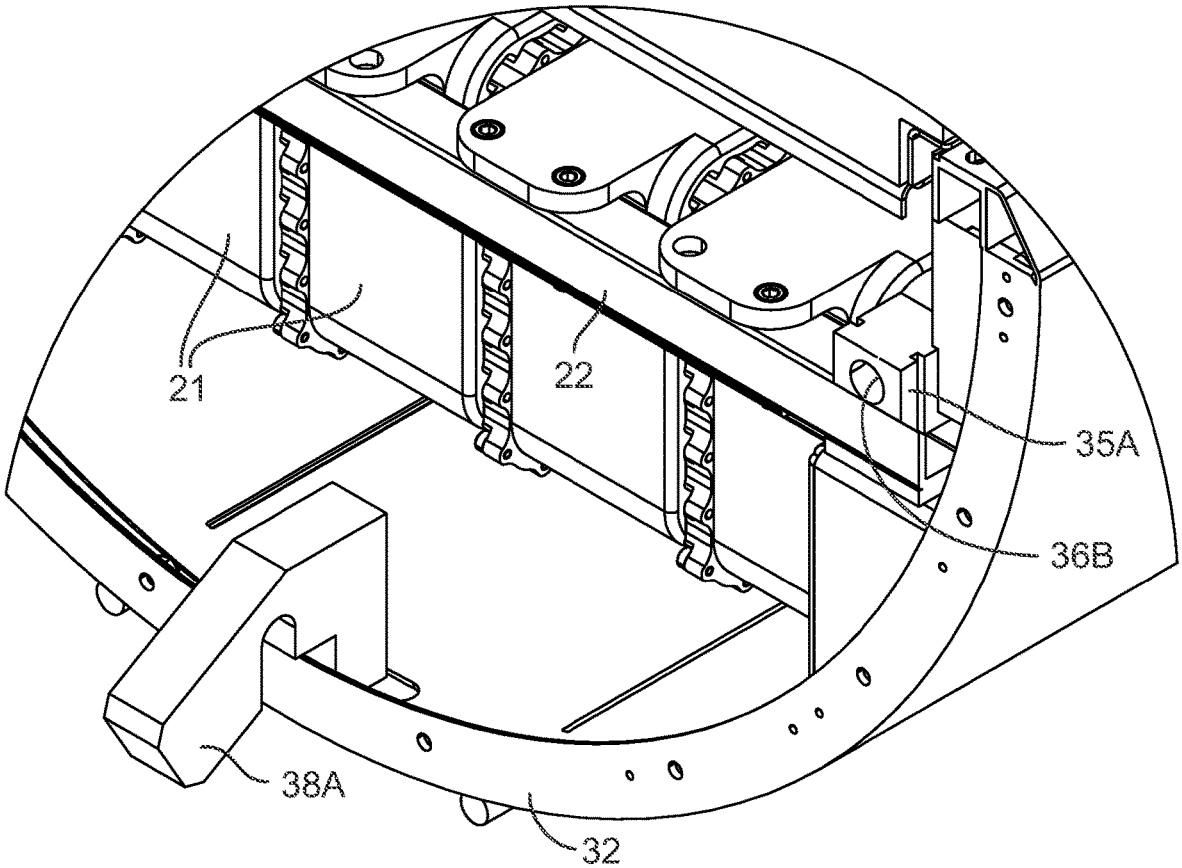
FIG. 11 is a fragmentary enlargement of the area designated at reference circle "A" in FIG. 10.
Figure 12:
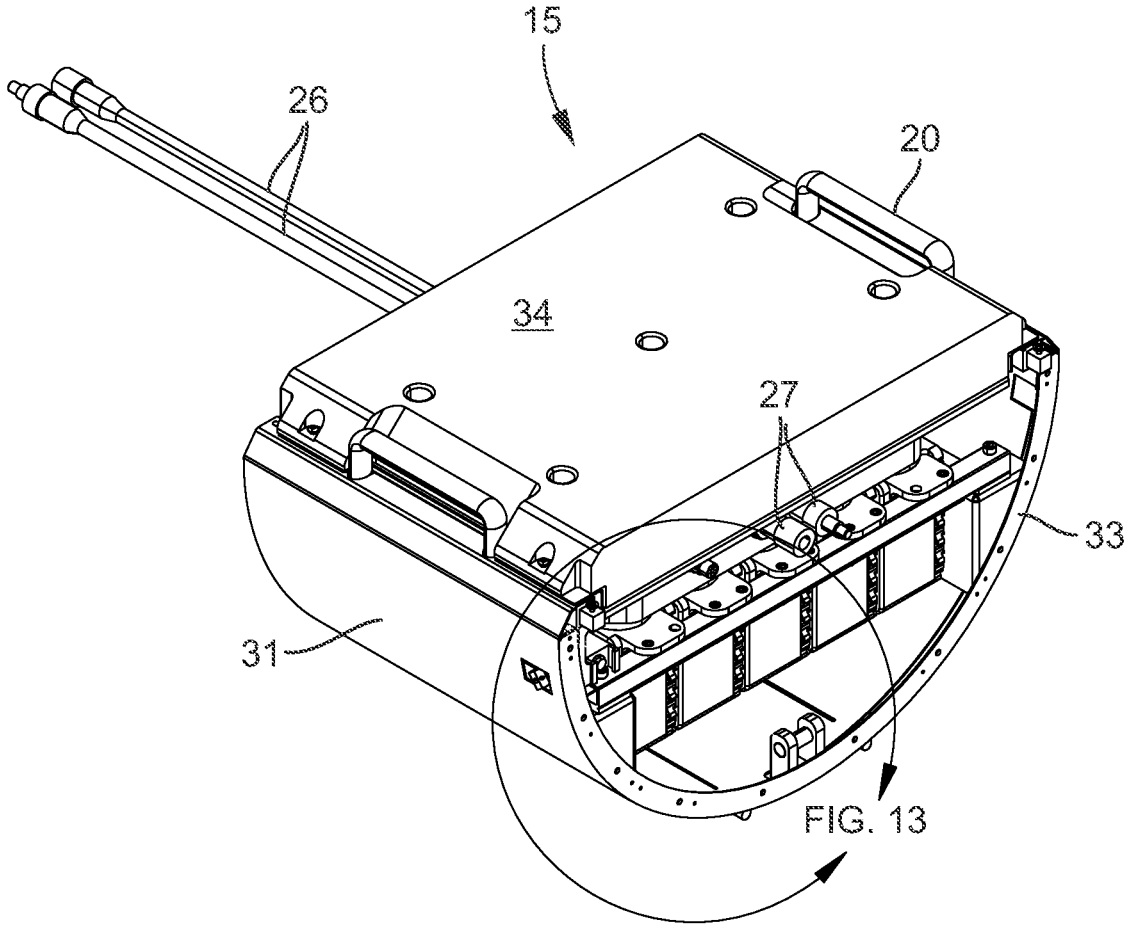
FIG. 12 is a rear end perspective view of the exemplary battery module.
Figure 13:
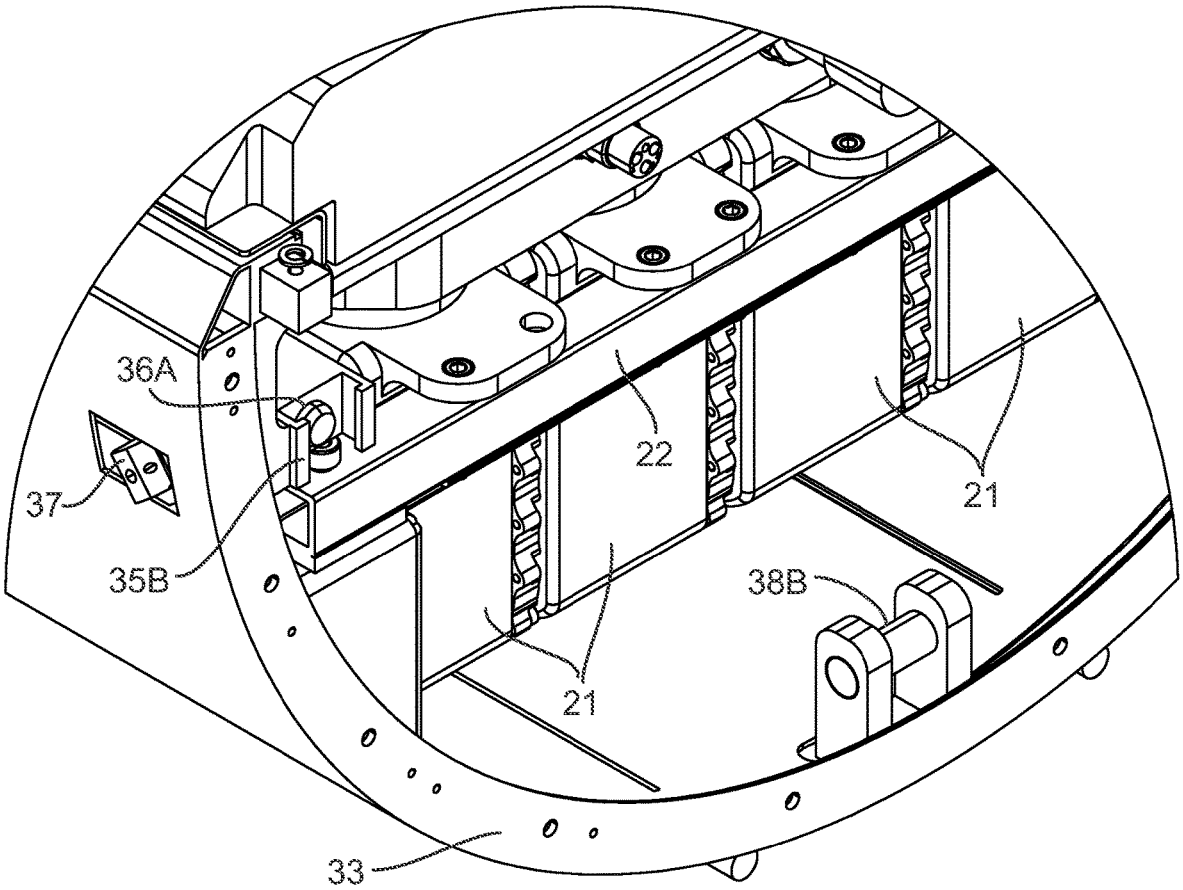
FIG. 13 is a fragmentary enlargement of the area designated at reference circle "B" in FIG. 12.

Referring now specifically to the drawings, a subsurface multi-mission diver transport vehicle (referred to herein as "SMV" or "vehicle") according to one embodiment of the present disclosure is illustrated in FIGS. 1 and 2, and shown generally at broad reference numeral 10. In exemplary embodiments, the present SMV 10 comprises a "wet" underwater propulsion vehicle capable of transporting a single diver "D" or a group of divers in tow, thereby minimizing physical exertion and allowing maximum effective usage of diver gear and equipment. As divers are exposed underwater, standard SCUBA gear or Rebreathers may be utilized in combination with the present vehicle. In one embodiment, the SMV 10 may be rated for underwater travel at speeds up to 5 knots for 2 hours. As discussed further below, the exemplary SMV 10 features system modularity and scalability which enable mission-specific customization.

As best illustrated in FIGS. 2-5, one exemplary configuration the present SMV 10 comprises a generally tubular-shaped vehicle body 11 incorporating a number of replaceable, detachable and exchangeable mission modules—e.g., front module 14, battery modules 15, 16, and rear module 17. The individual mission modules 14-17 of the SMV 10 are mechanically assembled together inline to form a substantially continuous U-shaped exterior hull 11A and a substantially flat continuous deck 11B of the vehicle body 11. The battery modules 15, 16 supply electrical current (in parallel) to electrical subsystems of the vehicle. The front and rear modules 14, 17 comprise respective pairs of thrusters 18A, 18B and 19A, 19B capable of propelling and maneuvering the SMV 10, as controlled by the diver-operator, remotely or autonomously. Each of the mission modules 14-17 may further comprise port and starboard diver handles 20, and other ergonomic grips, toeholds and features not shown.

Exemplary Battery Module 15, 16

Referring to FIGS. 1 and 5-9, in exemplary embodiments the present SMV 10 incorporates multiple inline battery modules 15, 16 as indicated above. FIG. 6-9 illustrate a single battery module 15—it being understood that battery module 16 is identical to module 15. Each battery module 15, 16 comprises several individual and electrically isolated lithium-ion battery packs 21, best shown in FIGS. 8 and 9, held in an undercarriage 22 (chassis) and electrically wired to a distribution manifold 24. Each battery pack 21 may have a nominal rating of 50.89V and 21 Ah (1068 Wh), while each battery module 15, 16 may have a nominal rating of 50.89V and 105 Ah (5343 Wh). In addition, because the individual battery packs 21 are isolated, any thermal runaway with a single battery pack will not propagate to the adjacent battery packs. As such, the other battery packs 21 in the battery module 15, 16 remain safe and effective for continued use.

Flexible sheathed battery cables 26 (positive and negative leads) and complementary male and female cable connectors 27 are located at opposite ends of each battery module 15, 16. The battery cables 26 and connectors 27 electrically connect to the distribution manifold 24, and function to transfer electrical current between and among the various interconnected mission modules 14-17 of the SMV 10. The battery cables 26 of module 15 electrically connect to male and female battery connectors 27 of the front module 14, while the flexible cables 26 of adjacent battery module 16 connect to respective male and female battery connectors 27 of module 15.

Figure 14:
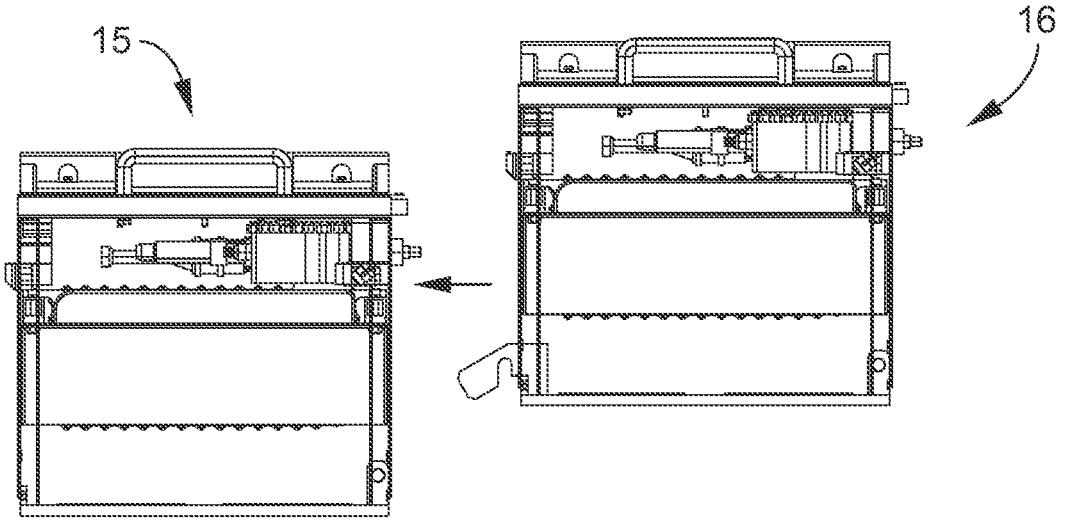
FIGS. 14-16 are side views demonstrating sequential assembly of two adjacent battery modules.
Figure 15:
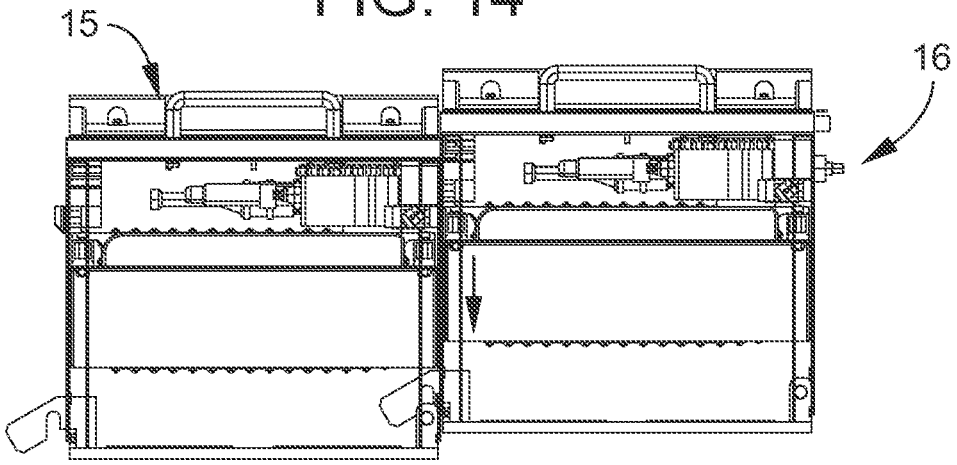
Figure 16:
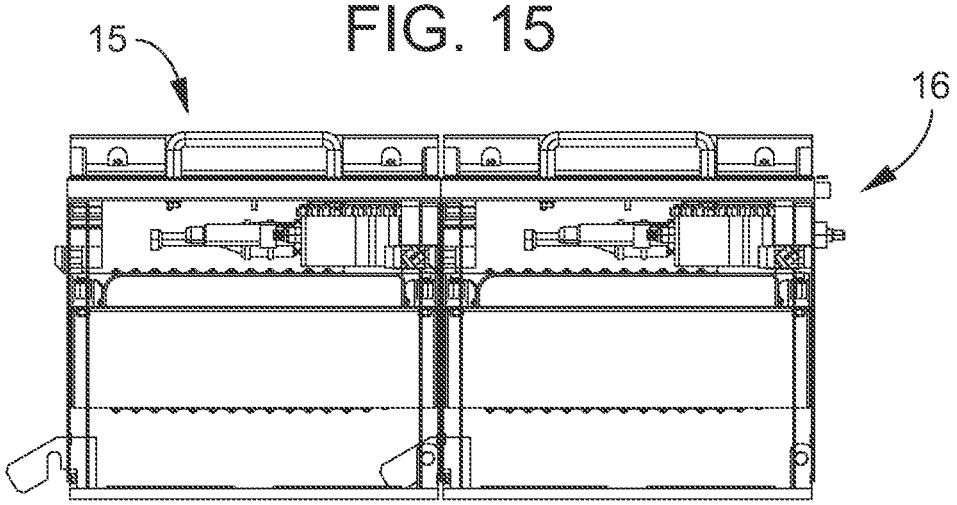

Referring to FIGS. 10-13, each battery module 15, 16 has a substantially U-shaped exterior hull section 31 with corresponding U-shaped end flanges 32, 33 and a substantially flat top deck section 34. The hull sections 31, end flanges 32, 33 and deck sections 34 of adjacent modules 15, 16 align substantially seamlessly when assembled. In this manner, by incorporating virtually any desired number of battery modules 15, 16 end-to-end, an overall structural length of the SMV 10 and its resulting diver and power capacity can be readily customized for mission-specific applications. In the exemplary embodiment, each battery module 15, 16 has multiple points of quick-release interlocking mechanical connection: (a) male and female dovetails 35A, 35B; (b) spring-loaded extension pin and receptacle 36A, 36B (with release 37); and (c) bottom latch and saddle pin 38A, 38B. Sequential assembly of adjacent battery modules is demonstrated in FIGS. 14, 15, and 16. Additional identical battery modules (not shown) may be incorporated into the SMV 10 and operatively electrically and mechanically interconnected inline in this same manner.

One advantage of the exemplary SMV 10 is an ability to quickly expand the power source (i.e., the "fuel") by attaching additional battery modules 15, 16, as previously described. In theory, an unlimited number of battery modules 15, 16 can be combined to allow the vehicle to operate for extended durations. Additionally, the SMV 10 may be further customized by incorporating structurally similar modules designed for equipment storage, boat air (e.g., SCUBA, Rebreathers), and other mission-specific requirements, accessories, implements and component upgrades. The overall dimensions of the exemplary SMV 10 with one battery module installed are: 29 inches wide×18.5 inches tall×79 inches long. This exemplary configuration will have a dry weight of approximately 375 pounds. Each additional battery module adds 18 inches in length and 125 pounds of dry weight to the SMV. Individual mission modules 14-17 may be integrated with foam for buoyancy compensation, such that the effective weight of the SMV 10 is substantially neutral in water.

Exemplary Front Module 14

Figure 17:
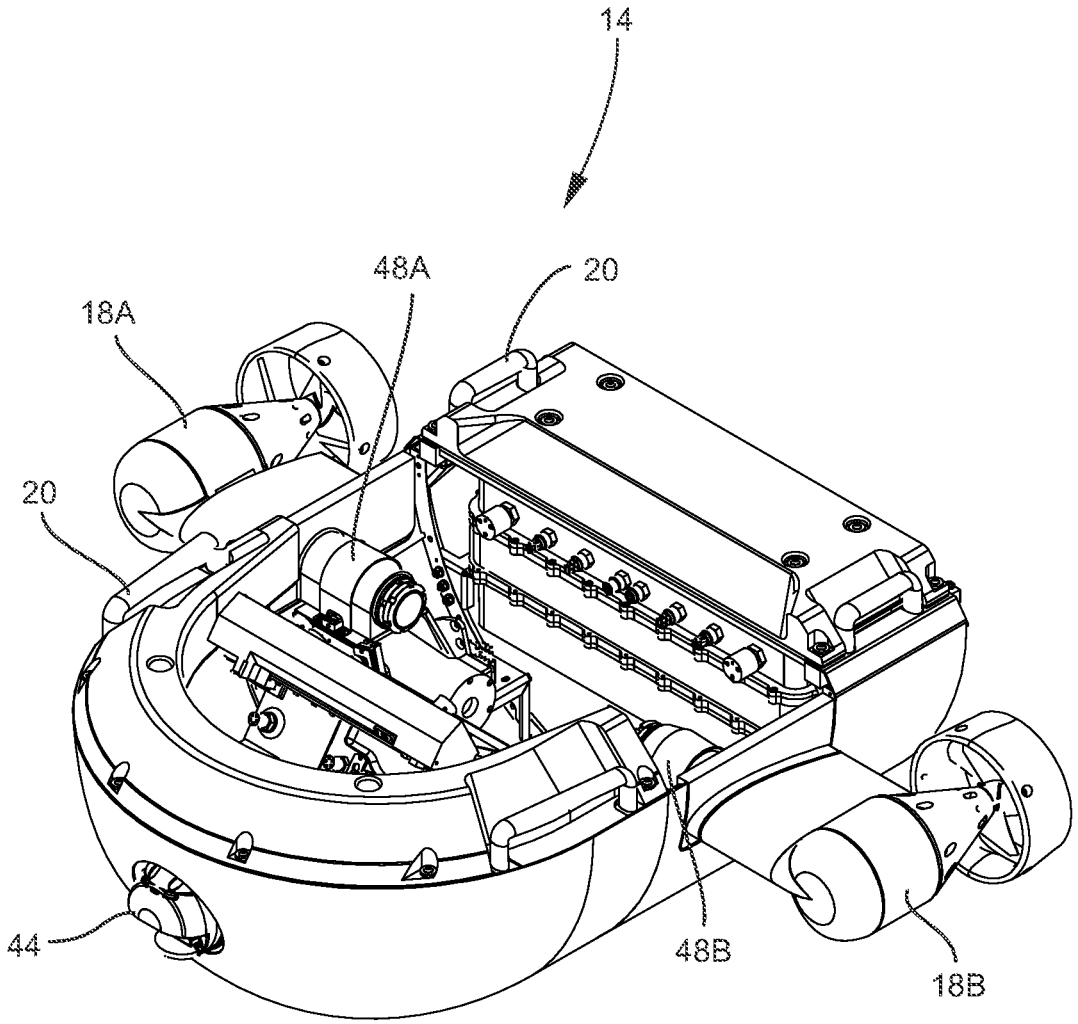
FIG. 17 is a perspective view of an exemplary front module incorporated in the present vehicle.
Figure 20:
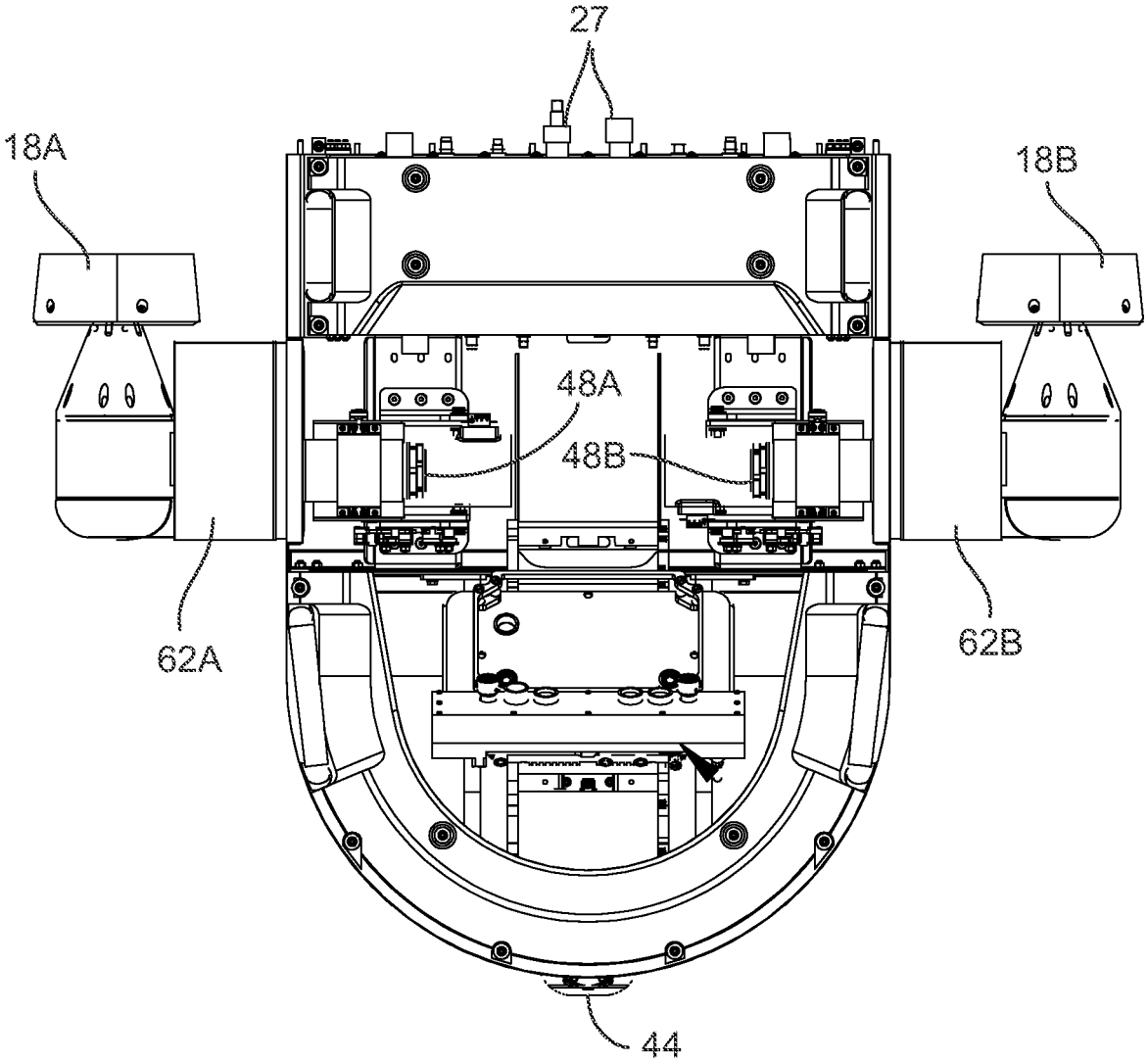
FIG. 20 is a top view of the exemplary front module.
Figure 21:
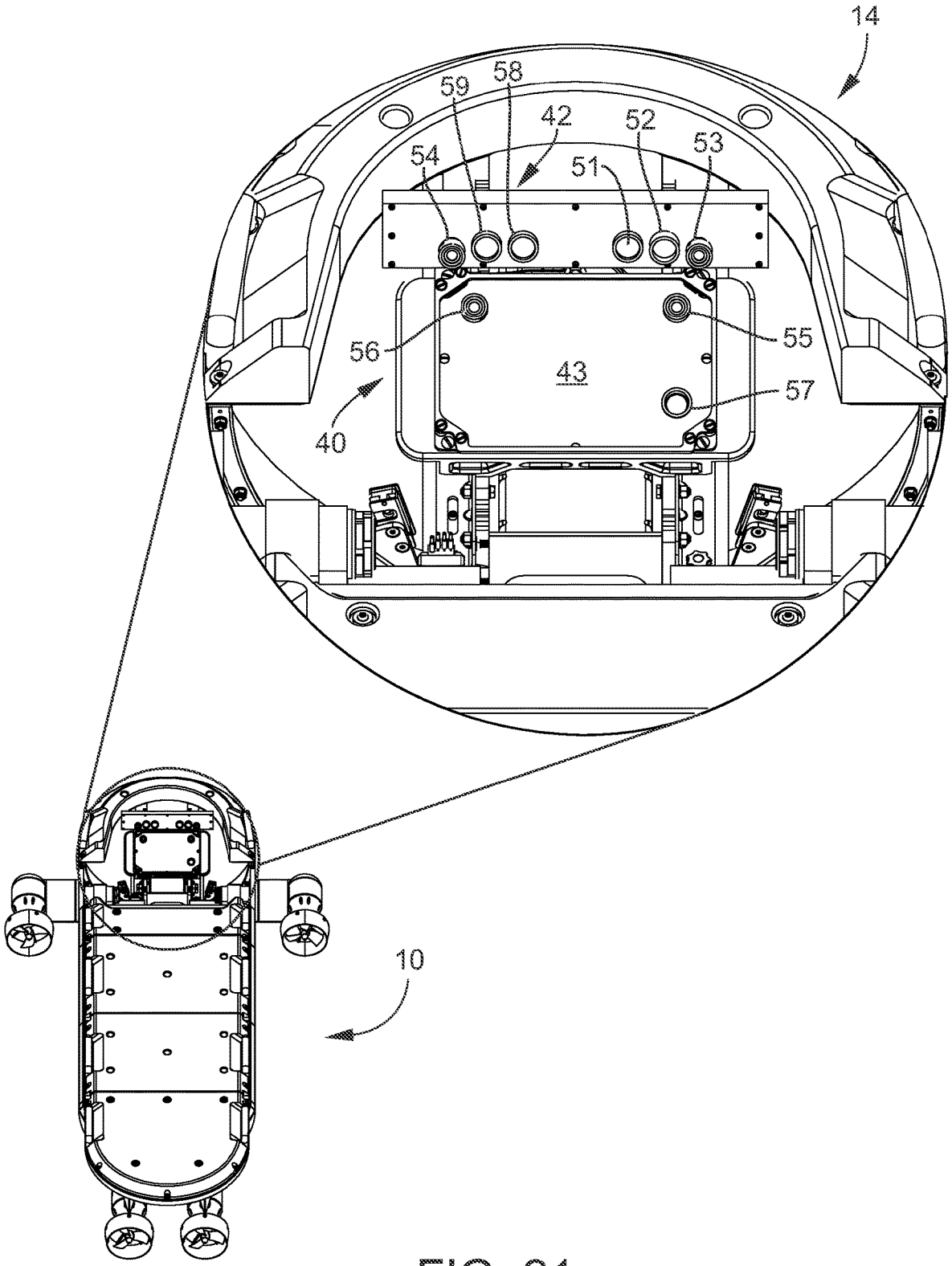
FIG. 21 is a fragmentary enlargement of the front module in an area designated at reference circle "A"
Figure 22:
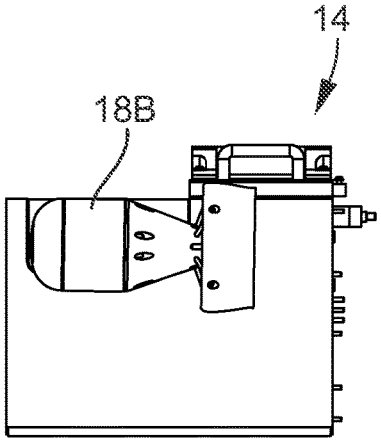
FIGS. 22-25 are side views demonstrating adjustability of the front module thrusters.
Figure 23:
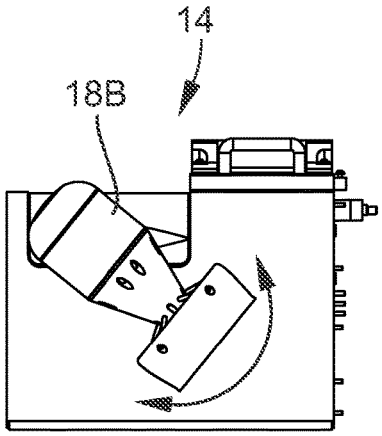
Figure 24:
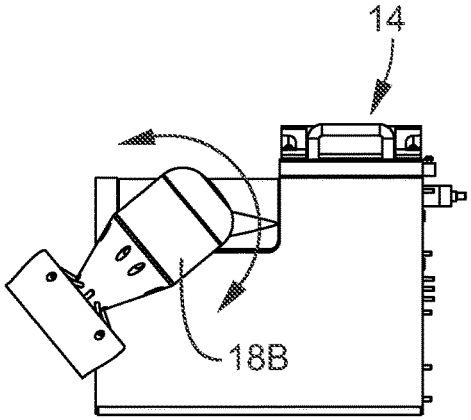
Figure 25:
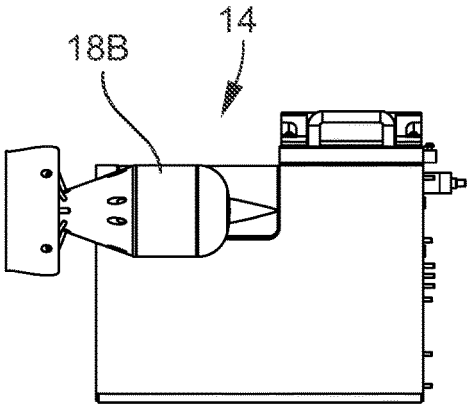

Referring to FIGS. 5 and 17-21, the front module 14 of the exemplary SMV 10 is detachably connected to the battery module 15 using mechanical fasteners or other quick-connect/quick-release fittings or couplings. The front module 14 has a substantially U-shaped exterior hull section with a corresponding U-shaped rear end flange and a substantially flat top deck section. As best shown in FIGS. 17 and 21, the exemplary front module 14 incorporates an internal drive control system 40, manual diver controls (interface) 42, navigator display screen 43, forward-facing sonar 44, the adjustable port and starboard thrusters 18A, 18B, and integrated servomotors 48A, 48B operatively connected to the thrusters 18A, 18B. The diver controls 42 may include a main power toggle button 51, a thrust hold toggle button 52, horizontal and vertical thrust joysticks 53, 54, a display curser joystick 55, a display interaction button 56, a display power toggle button 57, an auto depth control toggle button 58, and vehicle lights toggle button 59. All electronics of the exemplary SMV 10 may communicate with the drive control system 40 either wirelessly (e.g., via RF or IR connections) or through wired connections.

The exemplary drive control system 40 is immediately responsive to various manual diver controls 42, and incorporates a drive box controller comprising hardware and software that manages or directs the flow of signals and data between the diver interface controls 42, thrusters 18A, 18B, servomotors 48A, 48B, and positioners and other electronics. The exemplary controller may comprise or incorporate a processor. In certain embodiments, the processor may be implemented by a microcontroller, a digital signal processor, or FPGA (field programmable gate array) for performing various SMV control functions. In its manual-operation mode, the exemplary SMV 10 relies on realtime user input to set direction, thrust levels, and prevent obstacle collisions.

In alternative embodiments, the exemplary SMV 10 may be equipped with electronic navigation allowing operation in an autonomous mode. The autonomous navigation relies on sonar and Doppler feedback supplied to the navigation system for obstacle detection. The system will see the obstacle and make necessary path adjustments to avoid collision. Pre-loaded maps of the underwater area are loaded in the system and used to chart an original course. A GPS transceiver may also combine with the navigation system to determine initial position as well as confirm critical checkpoints along the course. In its autonomous-operation mode, the exemplary SMV 10 may be applicable for autonomous delivery of divers and equipment to a job site, unmanned or manned control, and scientific and educational discovery along with the study of marine biology and geography.

Figure 18:
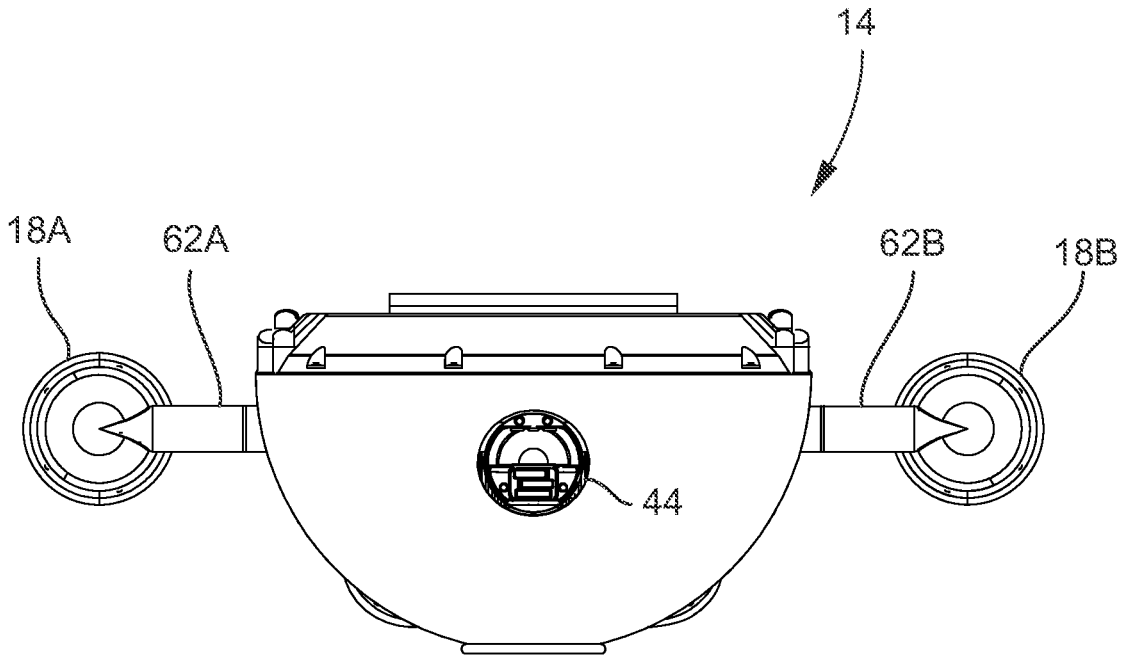
FIG. 18 is a front end view of the exemplary front module.
Figure 19:
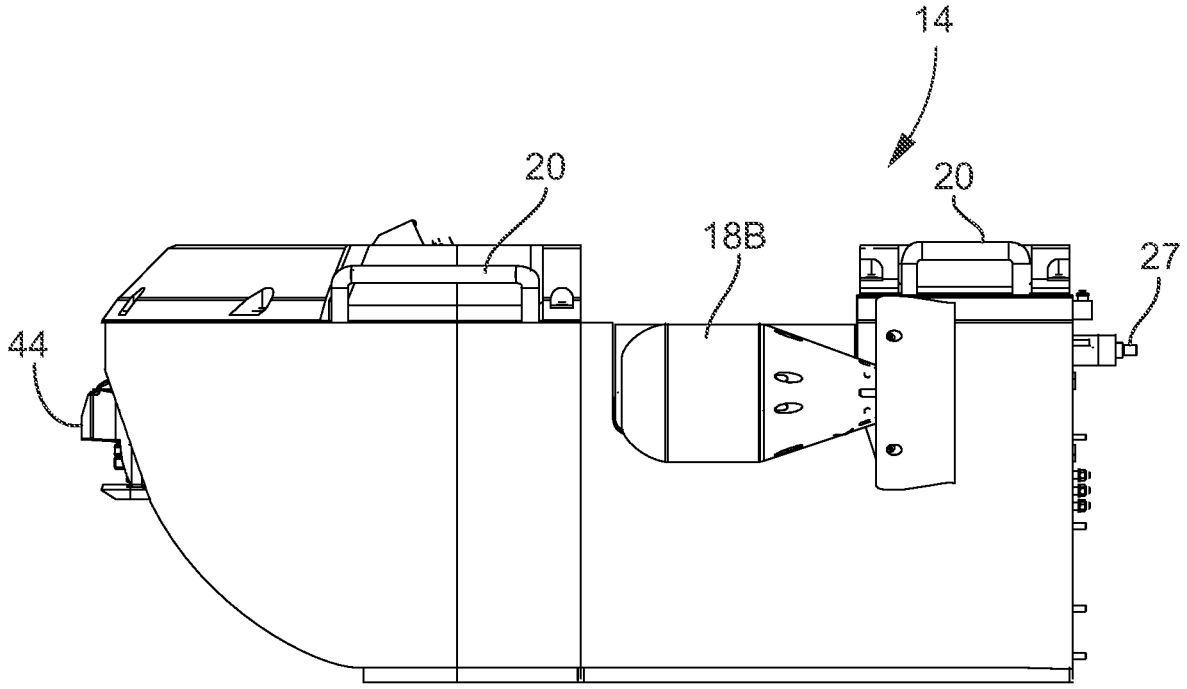
FIG. 19 is a side view of the exemplary front module.
Figure 26:
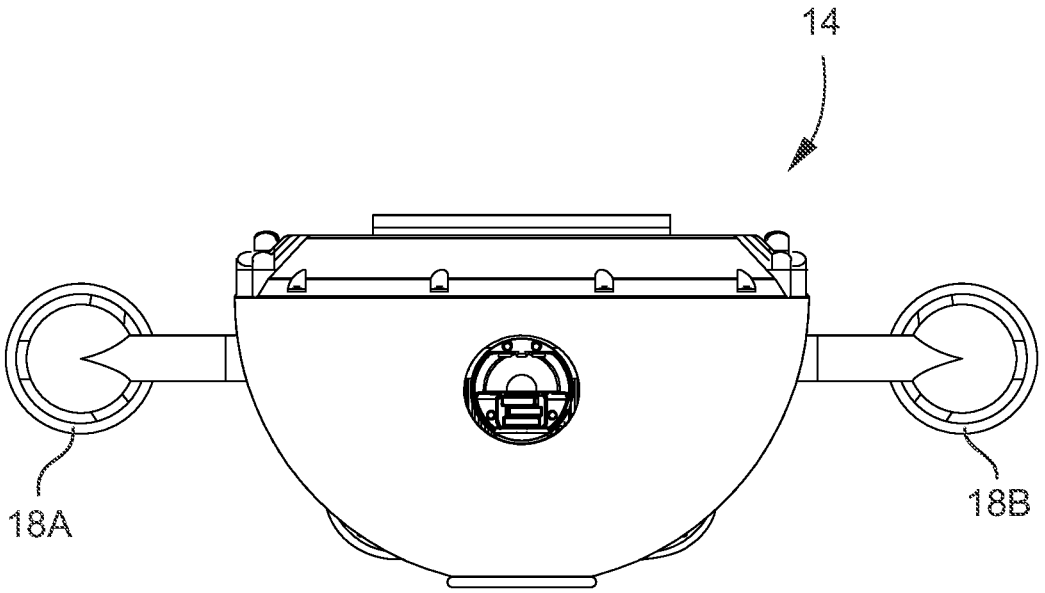
FIGS. 26 and 27 are end views demonstrating movement of the front module thrusters from a deployed condition to a stowed condition.
Figure 27:
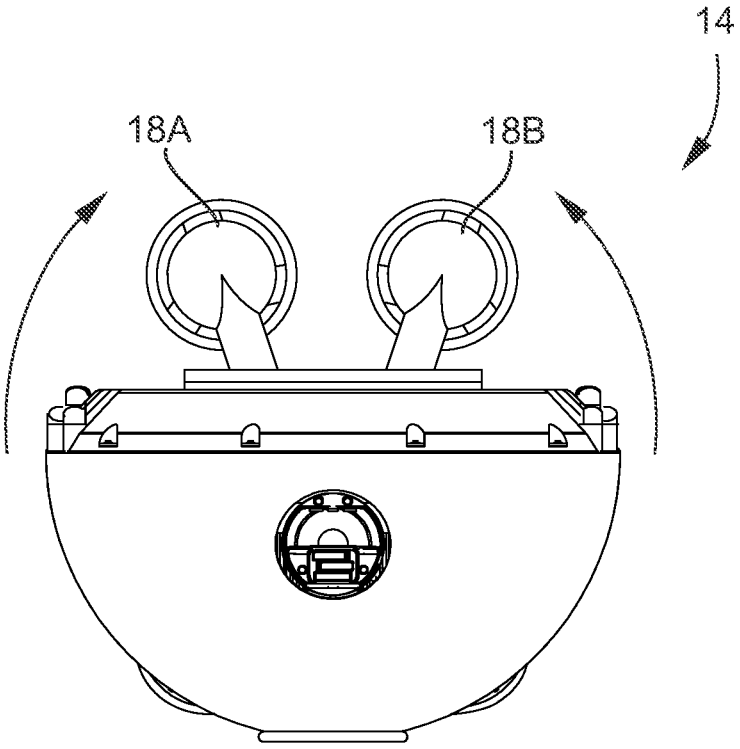
Figure 28:
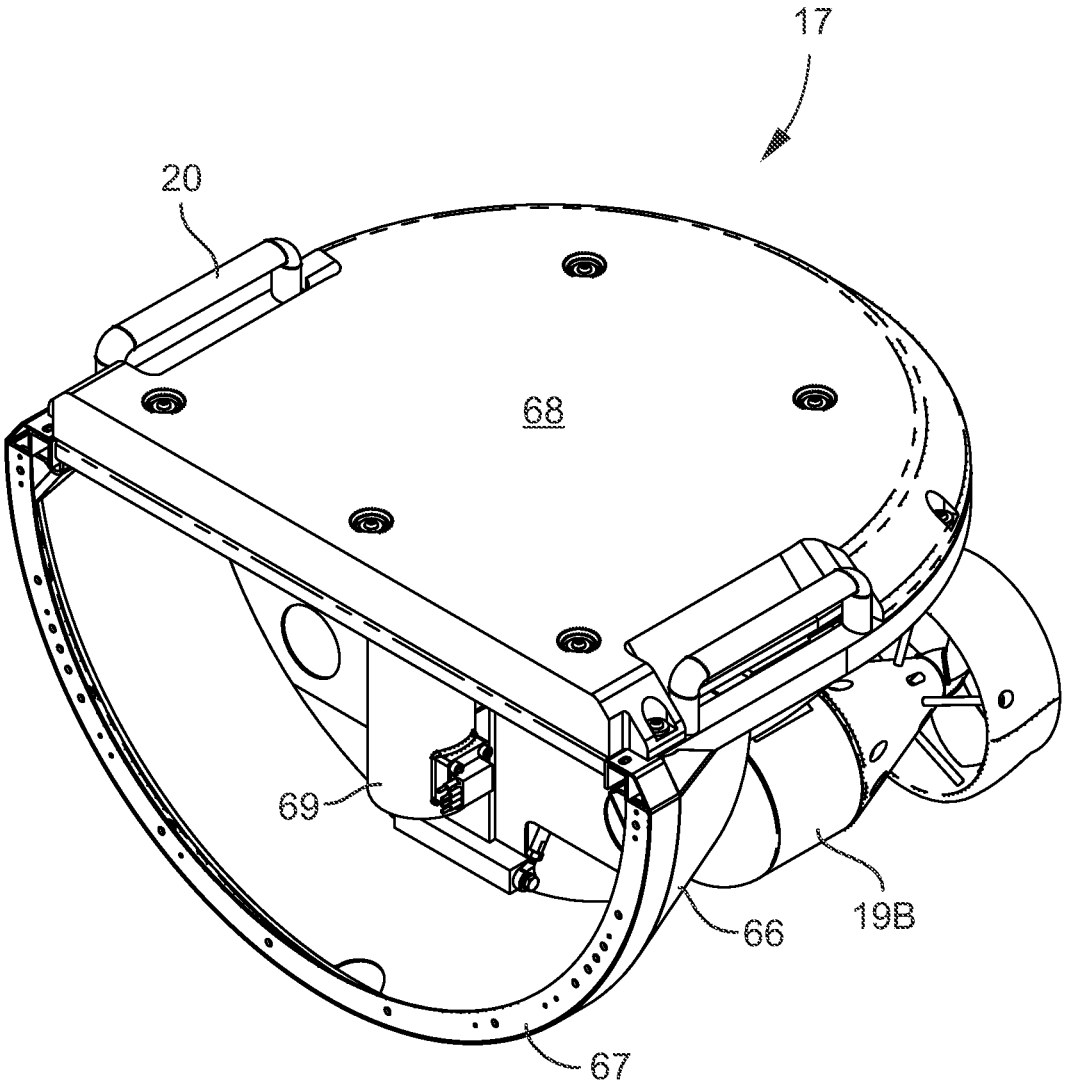
FIG. 28 is a front perspective view of an exemplary rear module incorporated in the present vehicle.
Figure 29:
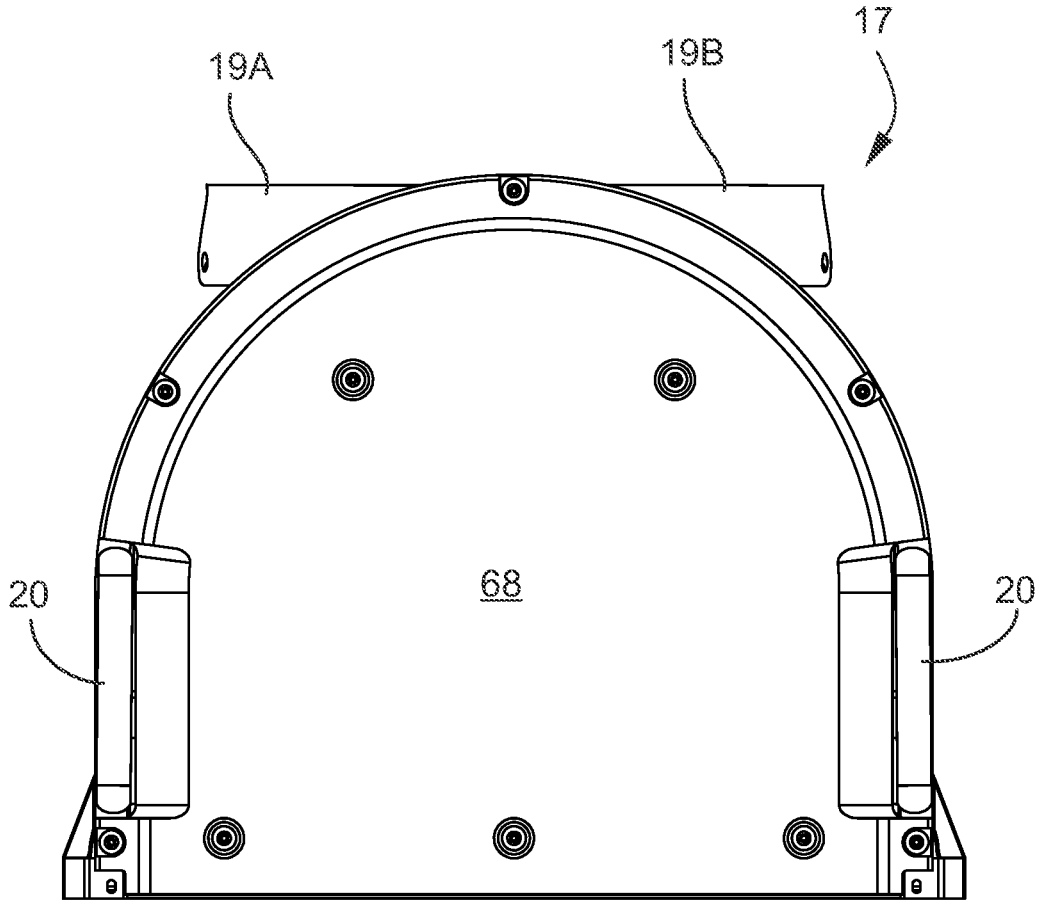
FIG. 29 is a top view of the exemplary rear module.
Figure 30:
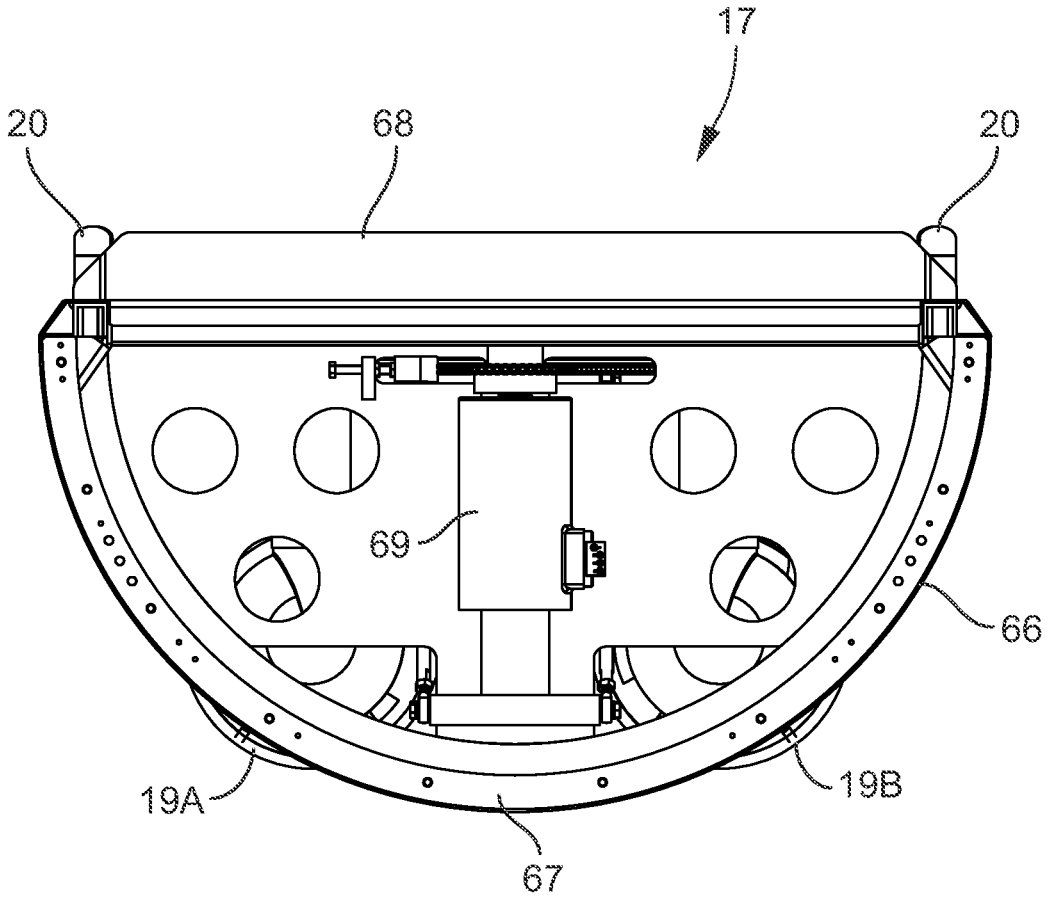
FIG. 30 is a front end view of the exemplary rear module.
Figure 31:
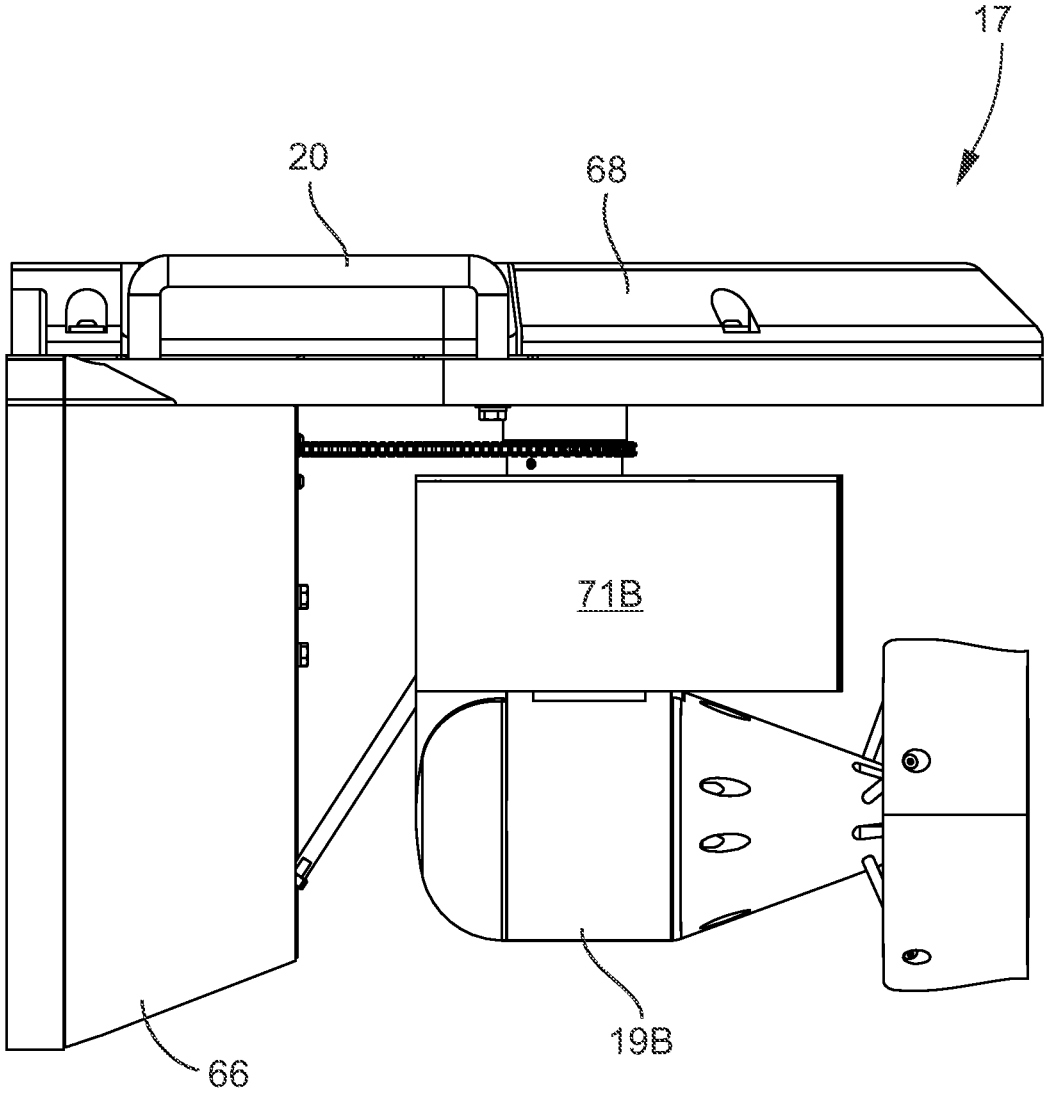
FIG. 31 is a side view of the exemplary rear module.

As best shown in FIGS. 18 and 20, the port and starboard thrusters 18A, 18B of the front module 14 are adjustably carried by respective pivotably mounted hydrofoils 62A, 62B, and are operatively connected to the drive control system 40 and respective integrated servomotors 48A, 48B. Each servomotor 48A, 48B incorporates a built-in DC motor, variable resistor, gears, encoder and other associated control circuitry and electronics. The servomotors 48A, 48B operate on PWM (pulse width modulation) principles to pivot and rotate the thrusters 18A, 18B, as shown in FIGS. 22-25, to maintain vehicle pitch and roll, while also providing forward thrust. The exemplary thrusters 18A, 18B may be capable of rotating 180 degrees to provide maximum maneuver response as well as aid in station-holding during autonomous use of the SMV 10. Additionally, as demonstrated in FIGS. 26 and 27, the thrusters 18A, 18B may be designed to fold upward from a deployed condition to a stowed condition into the "signature" of the front module 14. Each exemplary thruster 18A, 18B outputs approximately 70 pounds of thrust, generating a projected underwater velocity of approximately 5 knots at full power for approximately 2 hours.

Exemplary Rear Module 17

Figure 32:
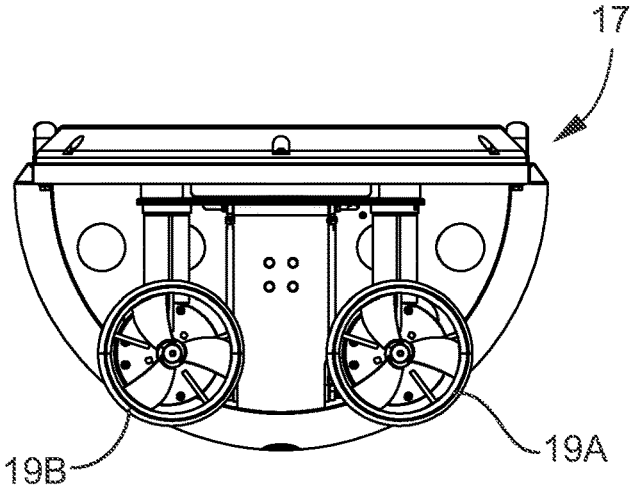
FIGS. 32-34 are rear end views of the exemplary rear module demonstrating pivoting movement of the two rear thrusters.
Figure 33:
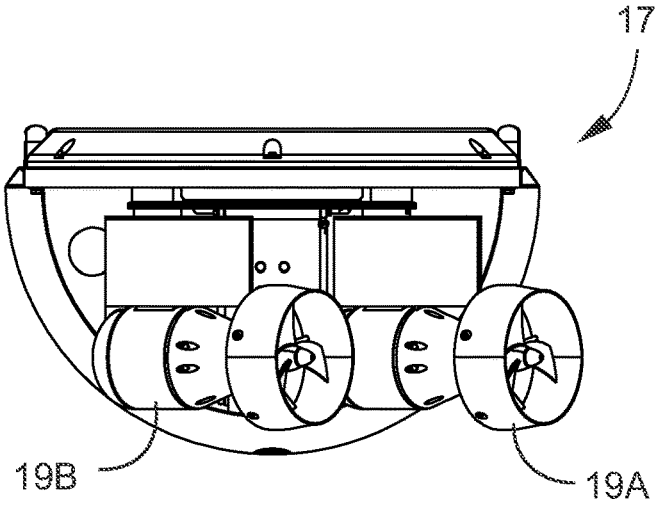
Figure 34:
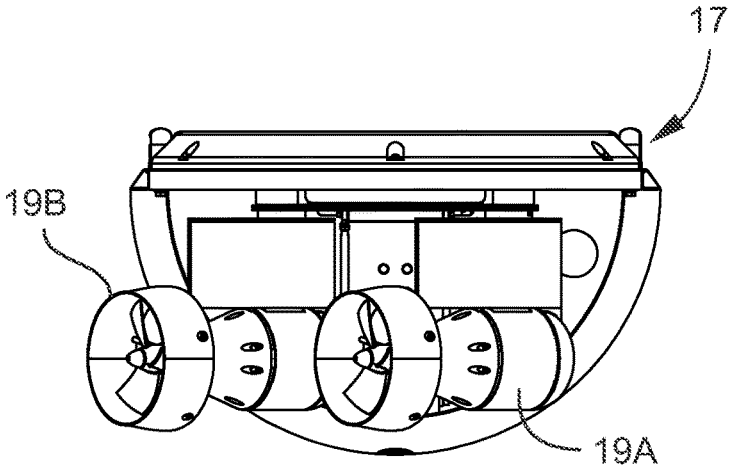

Referring to FIGS. 28-31, the rear module 17 of the exemplary SMV 10 is removably attached to the battery module 16 using any suitable hardware or other quick-connect/quick-release fittings or couplings, and has a substantially U-shaped exterior hull section 66 with a corresponding U-shaped front end flange 67 and a substantially flat top deck section 68. The rear module 17 incorporates an integrated servomotor 69 communicating with the drive control system 40 and operatively connected to the first and second rear thrusters 19A, 19B. As described above, the servomotor 69 operates on PWM principles and incorporates a built-in DC motor, variable resistor, gears, encoder and other associated control circuitry and electronics. The thrusters 19A, 19B are adjustably carried on respective pivotable hydrofoils 71A, 71B in a manner such as previously described. FIGS. 32-34 demonstrate pivoting side-to-side movement of the rear thrusters 19A, 19B, as controlled by the diver, remotely or autonomously. The rear thrusters 19A, 19B cooperate to maintain yaw control and aid in vehicle steering.

For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under 35 U.S.C. § 112(f) [or 6th paragraph/pre-AIA] is not intended. Additionally, it is not intended that the scope of patent protection afforded the present invention be defined by reading into any claim a limitation found herein that does not explicitly appear in the claim itself.

What is claimed:

1. A subsurface diver transport vehicle, comprising:

a vehicle body comprising a plurality of individual mission modules mechanically assembled together to define a substantially continuous hull and deck of said vehicle, and wherein said plurality of mission modules comprises at least one detachable battery module adapted for supplying electrical current to electrical subsystems of said vehicle;

at least one thruster residing adjacent said vehicle body and capable of propelling said vehicle through a body of water; and a pivoting hydrofoil adjustably attaching said thruster to said vehicle body.

2. The subsurface diver transport vehicle according to claim 1, wherein said plurality of mission modules comprises a detachable rear module.

3. The subsurface diver transport vehicle according to claim 2, wherein said at least one thruster comprises port and starboard thrusters.

4. The subsurface diver transport vehicle according to claim 3, wherein said port and starboard thrusters reside adjacent said rear module.

5. The subsurface diver transport vehicle according to claim 4, and comprising first and second pivoting hydrofoils adjustably attaching respective port and starboard thrusters to said rear module.

6. The subsurface diver transport vehicle according to claim 5, wherein said rear module further comprises integrated servomotors operatively connected to said port and starboard thrusters.

7. The subsurface diver transport vehicle according to claim 1, and comprising an integrated servomotor operatively connected to said thruster.

8. The subsurface diver transport vehicle according to claim 1, and comprising a drive control system adapted for controlling said thruster.

9. The subsurface diver transport vehicle according to claim 8, wherein said drive control system comprises a diver-operated joystick.

10. The subsurface diver transport vehicle according to claim 1, wherein said battery module comprises a flexible conductive battery cable extending from one end of said battery module and a complementary battery cable connector located at an opposite end of said battery module.

11. The subsurface diver transport vehicle according to claim 10, wherein said battery module further comprises a distribution manifold and a plurality of individual battery packs electrically connected to said distribution manifold.

12. The subsurface diver transport vehicle according to claim 11, wherein said battery module further comprises an undercarriage for holding said plurality of battery packs.

13. The subsurface diver transport vehicle according to claim 1, wherein each of said mission modules has a substantially U-shaped exterior hull section and a substantially flat, continuous deck section.

14. The subsurface diver transport vehicle according to claim 1, wherein each of said mission modules comprises port and starboard diver handles.

15. The subsurface diver transport vehicle according to claim 1, wherein each of said mission modules has a substantially U-shaped end flange adapted for engaging a corresponding U-shaped end flange of an adjacent mission module.

16. The subsurface diver transport vehicle according to claim 1, wherein adjacent mission modules further comprise a locking latch and a complementary latch pin cooperating to mechanically connect said mission modules together.

17. A subsurface diver transport vehicle, comprising:

a vehicle body comprising a plurality of individual mission modules mechanically assembled together to define a substantially continuous hull and deck of said vehicle, said mission modules comprising a detachable rear module and at least one battery module adapted for supplying electrical current to electrical subsystems of said vehicle;

at least one rear thruster residing adjacent said rear module and capable of propelling said vehicle through a body of water; and a pivoting hydrofoil adjustably attaching said rear thruster to said rear module.

18. A subsurface diver transport vehicle, comprising:

a vehicle body comprising a plurality of individual mission modules mechanically assembled together to define a substantially continuous hull and deck of said vehicle, said mission modules comprising at least one detachable battery module adapted for supplying electrical current to electrical subsystems of said vehicle, and wherein said battery module comprises a flexible conductive battery cable and a complementary battery cable connector; and at least one thruster residing adjacent said vehicle body and capable of propelling said vehicle through a body of water.

* * * * *